United States Patent [19]

Hoshino et al.

[11] Patent Number: 4,672,877

[45] Date of Patent: Jun. 16, 1987

[54] TAILPIECE OF A GUITAR

[75] Inventors: Yoshiki Hoshino; Kazuhiro Matsui, both of Aichi, Japan

[73] Assignee: Hoshino Gakki Co., Ltd., Japan

[21] Appl. No.: 830,068

[22] Filed: Feb. 14, 1986

[30] Foreign Application Priority Data

Mar. 26, 1985 [JP] Japan ..... 60-044525[U]

[51] Int. Cl.[4] ..... G10D 13/04

[52] U.S. Cl. ..... 84/299; 84/267; 84/313

[58] Field of Search ..... 84/297 R, 298, 299, 84/307, 313, 267

[56] References Cited

U.S. PATENT DOCUMENTS

| | | | |
|---|---|---|---|
| 2,741,146 | 4/1956 | Fender | 84/313 |
| 4,608,905 | 9/1986 | Takabayashi | 84/313 |
| 4,611,523 | 9/1986 | McFarland | 84/313 |

FOREIGN PATENT DOCUMENTS

| | | | |
|---|---|---|---|
| 59-15987 | 1/1984 | Japan | 84/313 |

*Primary Examiner*—Lawrence R. Franklin

*Attorney, Agent, or Firm*—Ostrolenk, Faber, Gerb & Soffen

[57] ABSTRACT

A tailpiece and bridge assembly for a stringed musical instrument, comprising a housing attachable to the body of the instrument at the tailpiece. The housing having a pivot axle extending across it. A respective pivot lever for each of the instrument strings being pivotable about the pivot axle between a position toward the body and an upraised position. A string end securing body supported on the pivot lever and screw threadedly adjustable in position therealong for adjusting the tension of the string. A saddle disposed between the pivot axle and the string securing body, and upon the lever being lowered, the string wraps about the top of the saddle, initially tensioning it. A latch on each lever releasably latches the lever to the housing.

15 Claims, 3 Drawing Figures

TAILPIECE OF A GUITAR

BACKGROUND OF THE INVENTION

The present invention relates to a tailpiece for a guitar, and more particularly to a tailpiece which facilitates rapid guitar string replacement and string tension adjustment.

The string of a guitar typically extends from a respective peg on the peghead of the guitar and over the neck of the guitar, the body of the guitar, past the pickup if it is an electric guitar, over the bridge and it is then anchored on the tailpiece at the bottom or base of the guitar. Installation of the string usually requires substantial winding of a length of the string at the peg. This is a time consuming process and the string is generally longer than desirable.

In some guitars, the bridge and tailpiece are combined into a single tailpiece assembly. On some occasions, the bridge and tailpiece assembly is movable, by a tremolo arm, or the like, with respect to the body of the guitar to which the assembly is secured.

SUMMARY OF THE INVENTION

It is the primary object of the present invention to easily mount and tension individual strings of a guitar.

Another object of the invention is to provide such mounting of a string which also permits fine tuning by fine adjustments of string tension.

Another object of the invention is to avoid the need for a too long string and to avoid excess winding of the string during string installation and string tension adjustment.

A further object of the invention is to enable fine tuning of the guitar string once it has been attached on the musical instrument.

According to the present invention, the combined tailpiece and bridge assembly is securable to the top face of the body of the guitar at the rear or base end where the tailpiece is normally installed. Each string extends from its peg at the peghead, passes over a respective bridge saddle on the tailpiece and bridge assembly which saddle is placed where the guitar bridge normally is located. From the saddle, the string extends to and is secured to a pivotable lever which serves as the tailpiece and the string tension adjustment means. Each string is provided with a respective lever arrangement which includes a main body in the form of a pivotable lever that is pivotally attached for being pivoted up and down off the body of the guitar around a pivot axis defined at the front end of the tailpiece assembly, forward of the bridge saddle. The respective string extends over the bridge saddle and is secured to the lever rearward of the bridge saddle. Lowering the lever to its position on the face of the guitar body positions the string and initially tensions it.

On the lever there is a fine tuning mechanism, to which the string is secured. This tuning mechanism fine tunes the string by adjusting its tension. The fine tuning mechanism comprises a screw threaded arrangement movable along the lever, and rotation of the screw of the arrangement moves the string along the lever for adjusting its tension.

A latching arrangement for each of the pivotable levers is defined on the main body of the tailpiece assembly. When each pivot lever is lowered to the guitar body, the latch arrangement latches it there.

Other objects and features of the present invention will become apparent from the following description of a preferred embodiment of the invention considered in conjunction with the accompanying drawings.

DESCRIPTION OF THE PREFERRED EMBODIMENT

Figure 1:
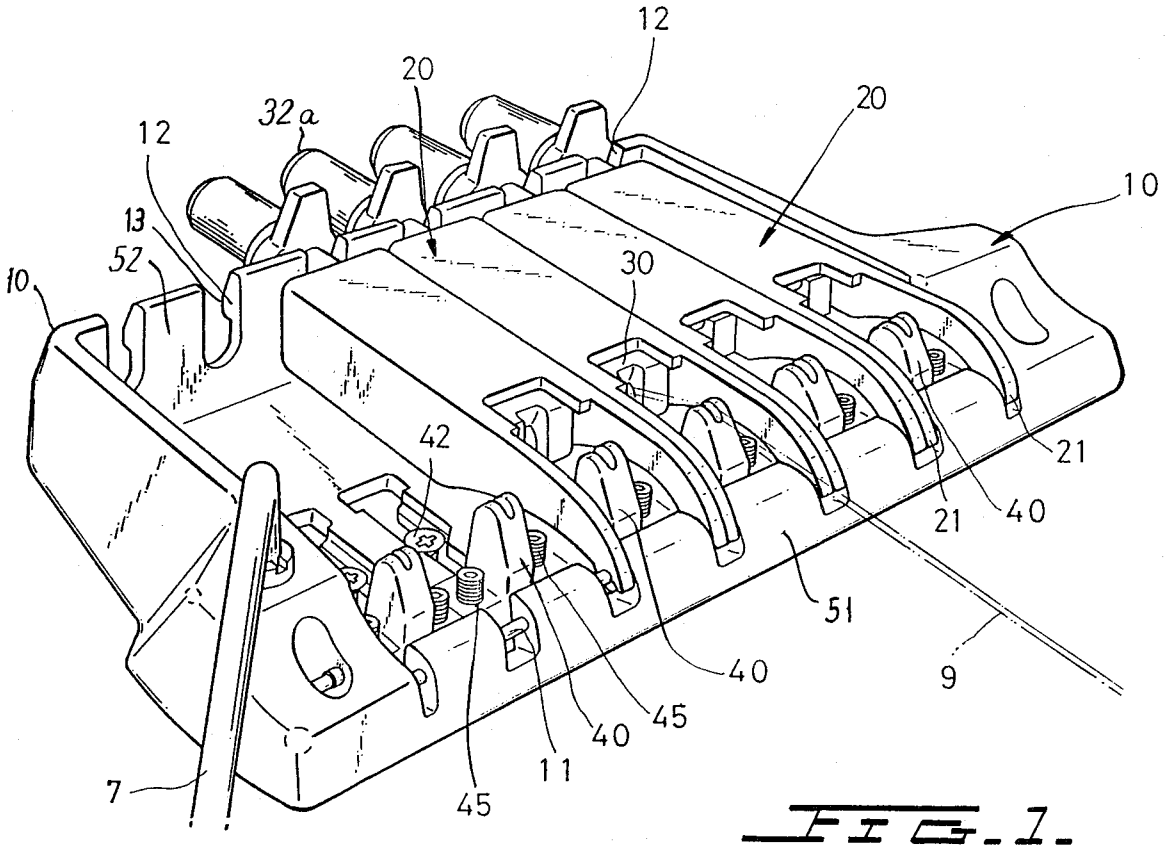
FIG. 1 is a perspective view of the entire tailpiece assembly of the present invention.
Figure 2:
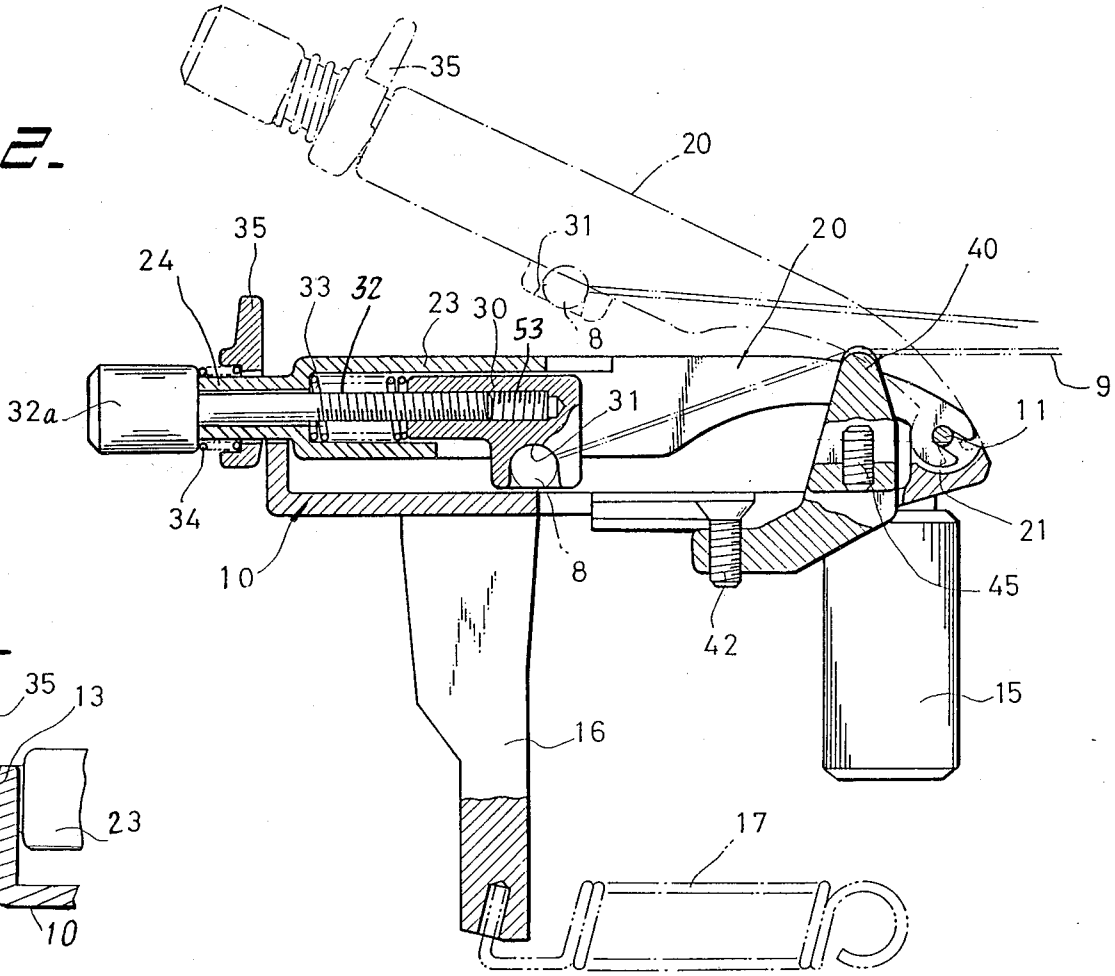
FIG. 2 is a longitudinal cross-section through the tailpiece assembly shown in FIG. 1.

Referring to FIGS. 1 and 2, there is illustrated the combined tailpiece and bridge assembly of a guitar (not shown). The assembly is mounted on the top surface or face of the body of the guitar, by means to be described below. The tailpiece and bridge assembly is placed on the rear end of the guitar in the location where the tailpiece would be located and it extends forward from the rear of the guitar to where the bridge for the strings would be normally found.

The present invention is particularly adapted for use on guitars. However, its use and adaptation for other string instruments would be apparent to one skilled in the art.

The tailpiece and bridge assembly of the present invention includes a main body 10 which, most broadly stated, is an open top flat box into which other elements of the assembly are installed. The front end wall 51 of the tailpiece assembly, shown at the right in FIG. 1, has a plurality of notches formed at spaced locations along its length for receiving the below described arms 21 of the individual pivot levers 20. A single axle pin 11 extends across the tailpiece assembly, and passes through the front wall and across each of the notches in the front wall of the tailpiece assembly for defining the pivot axle for all of the pivot levers, as described further below.

In the rear end wall 52 of the tailpiece assembly are defined a plurality of notches 12 which receive the rear, swingable ends of the levers 20 of the tailpiece assembly, also as described. The width of the notches is selected to maintain the positions of the levers side to side.

The rear wall 52 of body 10 also includes projecting steps 13 for cooperating with below described latches 35 for latching the levers 20 to the main body 10 of the tailpiece assembly, as described below.

The main body 10 of the tailpiece assembly includes an anchor 15 which extends down from the underside, at the forward end of the body 10, and is disposed inside the guitar body (not shown). There is also a tremolo lever 7 attached to the main body 10 and the main body may be tilted by the tremolo lever for creating the tremolo effect. The anchor 15 permits that tilting. Details of the tremolo apparatus are not here provided, as a conventional tremolo design may be used in connection with the main body.

Beneath the main body 10 is a depending portion 16 which extends inside the guitar body. At the bottom end of the depending portion 16 is a spring 17 which is hooked to an anchor, such as a hook or pin, inside the guitar body. The spring 17 cooperates with the tremolo lever for returning the main body 10 to its position toward the face of the body of the guitar.

To the main body 10 are pivotably supported a plurality of main body pivotable levers 20 which pivot between their solid line down position in FIG. 2, where they are latched in the main body 10, and their upraised broken line position. Each lever 20 is provided for a respective guitar string. Each lever is essentially of the same construction, and only one is now described. The lever 20 is a hollow body. At its forward end, to the right in FIG. 2, it is bifurcated, terminating in a pair of spaced apart arms 21. Each arm is provided with a notch at its end and that notch receives the above-described axle pin 11. The engagement of both arms 21 of the lever 20 with pin 11 provides the pivot axis for the main body lever 20.

The rear portion 23 of the lever 20 defines a closed chamber to define a channel for guiding forward and rearward movement of the string tension adjustment body 30, while prohibiting that body 30 from tilting with respect to the lever 20. Rearwardly of its portion 23, the lever 20 is narrowed at 24 for containing the spring 33 and supporting the knob 32*a*, described below.

The tension adjustment body 30 is of a height to fit in the channel defined for it in the lever portion 23. The body 30 has beneath it a string securing means in the form of a receiving notch 31 in which the ball or roller 8 at the rear end of the guitar string 9 is received. In this manner, the string 9 is anchored to the tension adjustment body 30. The notch 31 is beneath the body 30 and the lever 20, so that the string 9 will be bent down over the below described saddle 40.

The tension adjusting body 30 has a threaded opening 53. Into that opening is threaded the tension adjusting bolt 32. The rear holding part 24 of the lever portion 23 supports the shank of the bolt 32 and prevents it from rocking. The bolt 32 passes through the spring 34 which is outward of the main body 10 and through the spring 33 which is inward of the body 10. The springs together maintain the body 30 under proper tension and also permit a small amount of shifting of that body due to stresses on the string 9, operation of the tremolo, stresses due to pivoting of the lever 20, etc. The spring 33 which is inside the lever part 23, extends between the lever part 23 and the body 30 and urges the body 30 to the right in FIG. 2. The spring 34 extends between the knob 32*a* at the end of the bolt 32 and the next described latch 35.

Figure 3:
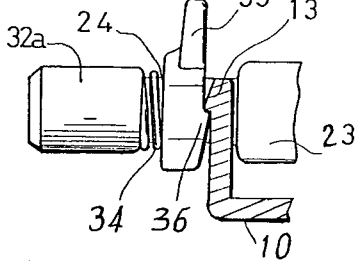
FIG. 3 is a fragmentary view of the rear portion of the tailpiece assembly illustrating the latching mechanism for elements of the tailpiece assembly.

Just rearward of the body 10 and inward of the head of the bolt 32 is positioned a latch 35 which cooperates with the lever 20 for latching the lever in the downward, solid line condition of FIG. 2. The latch 35 has a rearward projection 36, which latches beneath the step 13 on the rear edge of the rear wall 52 of the main body 10. The spring 34 resiliently permits the latch 35 to deflect when the lever 20 is lowered from its upraised to its lowered condition so that the elements 13, 36 may touch and snap past each other. For releasing the lever 20 from its latched, lowered condition, the latch lever 35 is tilted in the direction of the arrow in FIG. 3 against the bias of spring 34 to release the projection 36 from the step 13, and this permits raising of the lever 20.

At the forward end of the main body 10 is disposed a respective bridge saddle 40 for each of the strings. The saddle is carried on an elongate, curved arm. The rearward end of that arm is generally parallel to the underside of the body 10 and is fixed there by the bolt 42. Inside the upraised, forward part of the saddle is disposed an adjusting screw 45 which is internal to the saddle and which presses against the inside of the bottom of the body 10. Rotation of the adjusting screw 45 from outside the saddle 40 will permit slight pivoting of the saddle 40 around the fulcrum defined at the bolt 42 which permits slight adjustment in the height of the saddle 40. The top of the saddle 40 is sharply rounded and includes a respective notch 43 in which the string 9 is loosely received as it passes to the notch 31 in the body 30.

The use of the above tailpiece and bridge is now described. To install a string on the tailpiece assembly, the main body pivot lever 20 is unlatched and upraised to its broken line position of FIG. 2. The string attached at its respective peg (not shown) is brought to the notch 31 in the body 30 and the ball 8 at the end of the string is anchored in the notch 31. Then the lever 20 is lowered to its solid line position in FIG. 2, until the latch 35 latches the lever 20 to the body 10. This initially tensions the string. In this connection, the preferred maximum angle of rotation of the main body lever 20 is approximately 30°. The resulting tensile length of the string as a result of the rotation is in the range of 1.5 and 4 millimeters. It is desirable that the angle of rotation be fixed beforehand in response to the tensile length of each string, and that would mean appropriate adjustments in the angles of rotation.

Once the string 9 has been installed and the body 20 is lowered to its final position, the tension of the string can be adjusted by rotation of the knob 32*a* which rotates the bolt 32 and thereby moves the body 30 left and right, as appropriate, to adjust the string tension. This avoids the need for adjusting string tension at the peghead, although that is additionally possible.

With the present invention, the end of the string is first engaged with the main body pivot lever, which is then fixed in a horizontal position. In this manner, the guitar string can be installed under tension to some extent quite easily and quickly in a single operation. This avoids the need for winding and tightening an excessive length of string. Thereafter, string tension can be easily adjusted through the adjustment mechanism at the tailpiece assembly, without need for tension adjustment at the peghead. Very fine string tension adjustments are possible with the adjustment mechanism at the tailpiece assembly.

Although the present invention has been described in connection with a preferred embodiment thereof, many variations will now become apparent to those skilled in the art. It is preferred, therefore, that the present invention be limited not by the specific disclosure herein, but only the appended claims.

What is claimed is:

1. A tailpiece and bridge assembly for a stringed musical instrument, comprising:

a plurality of pivot levers, each pivot lever adapted to receive a respective string; means supported on the body of the instrument for defining pivots for the pivot levers, each pivot lever extending toward the rear of the stringed instrument from its pivot, each said pivot lever being independently pivotable on its pivot with respect to the other pivot levers between a position substantially toward the body of the instrument and a pivoted position upraised from the body of the instrument;

securing means on each pivot lever and spaced rearwardly from the pivot therefor, to which a respective string may be secured; the securing means on the lever being movable along the lever selectively rearwardly and forwardly of the guitar body for selectively adjusting the tension of the string; and bridge saddle means disposed on the body of the instrument rearwardly on the instrument of the pivots for the levers, and the levers extending rearwardly of the bridge saddle means; the bridge saddle means being forward on the instrument body of the securing means for the strings on the levers; the bridge saddle means including a top section over which the strings for the instrument can pass.

2. The tailpiece assembly of claim 1, further comprising releasable latch means for latching each pivot lever in the position toward the instrument body, and the latch means being releasable for enabling the lever to be pivoted away from the instrument body.

3. The tailpiece assembly of claim 1, wherein the support for the pivots comprises a housing in which all of the pivot levers are seated when the pivot levers are at their position toward the instrument body.

4. The tailpiece assembly of claim 3, further comprising latch means on the housing of the tailpiece assembly, and the latch means being for latching the pivot lever in the position toward the instrument body, and the latch means being releasable for enabling the lever to be pivoted away from the instrument body.

5. The tailpiece assembly of claim 4, wherein the latch means for the pivot lever comprises a step formed on the housing and a cooperating projection supported by the lever and so placed that the projection contacts the step as the lever is moved toward the instrument body; upon the projection contacting the step, the projection passes the step and becomes latched to the step; biasing means for urging the step and projection into engagement such that the projection is latched behind the step once the projection has passed the step.

6. The tailpiece assembly of claim 5, wherein the latch means comprises a tiltable element supported by the lever and tiltable against the bias of the biasing means for separating the projection and the step, and for releasing the latching of the pivot lever for permitting the pivot lever to be pivoted away from the instrument body.

7. The tailpiece assembly of claim 3, further comprising means on each lever for moving the securing means of the string along the length of the lever.

8. The tailpiece assembly of claim 7, wherein the securing means comprises a body to which the string is secured and the body being movable along the length of the lever and being supported on the lever, the body having a threaded bore therein, a screw extending into and mating with the bore in the movable body and the screw being supported to the housing for remaining substantially axially stationary as the rotatable screw is rotated, whereby rotation of the screw moves the movable body along the length of the lever for adjusting string tension.

9. The tailpiece assembly of claim 3, wherein the housing includes a rear wall which is located rearwardly of the securing means securing the strings to the pivot levers, the rear wall having notches therein through which the rear portions of the pivot levers extend and the notches being shaped for maintaining the orientations of the pivot levers against side to side motion.

10. The tailpiece assembly of claim 1, wherein the height of the bridge saddle means is adjustable with respect to the instrument body.

11. The tailpiece assembly of claim 1, further comprising a musical instrument string which is attachable to the securing means on the lever and which extends from the securing means over, past and in contact with the bridge saddle means.

12. The tailpiece assembly of claim 1, further comprising means on each lever for moving the securing means of the string along the length of the lever.

13. The tailpiece assembly of claim 12, wherein the means for moving the securing means comprises rotatable means supported to the lever and comprises a screw connection between the rotatable means and the securing means, and the screw connection therebetween being such that upon rotation of the rotatable means, the securing means for the string is movable along the lever.

14. The tailpiece assembly of claim 13, wherein the securing means comprises a body to which the string is secured and the body being movable along the length of the lever and being supported on the lever, the screw connection comprises the body having a threaded bore therein, the rotatable means comprising a screw extending into and mating with the bore in the movable body and the screw being supported to the support means for remaining substantially axially stationary as the rotatable screw is rotated, whereby rotation of the screw moves the movable body along the length of the lever for adjusting string tension.

15. The tailpiece assembly of claim 1, wherein the height of the top of the bridge saddle means is selected to be higher off the instrument body than the height of the securing means so that as each pivot lever is lowered toward the instrument body, the string contacts the top of the bridge saddle means and is bent thereabout.

* * * * *